US006459359B1

(12) United States Patent
Miyashita

(10) Patent No.: US 6,459,359 B1
(45) **Date of Patent: *Oct. 1, 2002**

(54) COMMUNICATION APPARATUS CAPABLE OF DISPLAYING THE NUMBER OF UNCONFIRMED MESSAGES

(75) Inventor: Yukio Miyashita, Shizuoka (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/123,527

(22) Filed: Jul. 28, 1998

(30) Foreign Application Priority Data

Jul. 28, 1997 (JP) ..... 9-201678

(51) Int. Cl.[7] ..... G08B 5/22

(52) U.S. Cl. ..... 340/7.51; 340/7.2; 340/7.43; 340/7.55; 340/7.61; 455/426

(58) Field of Search ..... 340/825.44, 311.1, 340/7.2, 7.51, 7.43, 7.55, 7.61; 455/38.1, 38.2, 38.4, 413, 414, 426, 412

(56) References Cited

U.S. PATENT DOCUMENTS 4,412,217 A * 10/1983 Willard et al. ..... 340/825.44
4,477,807 A * 10/1984 Nakajima et al. ..... 340/825.44
5,258,751 A * 11/1993 DeLuca et al. ..... 455/38.4
5,652,571 A * 7/1997 Shima et al. ..... 340/825.44
5,861,818 A * 1/1999 Ohtsuki ..... 340/825.44
6,032,039 A * 2/2000 Kaplan ..... 455/413

FOREIGN PATENT DOCUMENTS

| | | |
|---|---|---|
| JP | 58-501571 | 9/1983 |
| JP | 64-48944 | 3/1989 |
| JP | 4-273727 | 9/1992 |
| JP | 5-95322 | 4/1993 |
| JP | 7-79459 | 3/1995 |
| JP | 7-79466 | 3/1995 |
| JP | 8-191468 | 7/1996 |

* cited by examiner

*Primary Examiner*—Brian Zimmerman
*Assistant Examiner*—Yves DaLencourt
(74) *Attorney, Agent, or Firm*—McGinn & Gibb, PLLC

(57) ABSTRACT

A communication apparatus of the present invention includes a message storage and an unconfirmed message number storage. When the apparatus receives a radio signal, a message contained in the radio signal is written to the message memory. At the same time, the number of unconfirmed messages stored in the unconfirmed message number storage is incremented by 1 (one). An LCD (Liquid Crystal Display) and an alert section cooperate to alert the user of the apparatus to a call incoming. When the user presses a switch in response to the alert, a CPU (Central Processing Unit) determines that the user has confirmed the received message. At this time, the number of unconfirmed messages stored in the storage is decremented by 1 and then displayed on the LCD. If the user does not press the switch within a preselected period of time, then the CPU determines that the received message has not been confirmed, and displays the number of unconfirmed messages stored in the storage on the LCD.

24 Claims, 14 Drawing Sheets

Fig. 3a 5.05AM JUNE 7, 1998

* UNCONFIRMED MESSAGES STORED *

3

Fig. 3b 13.10PM JUNE 7, 1998

* UNCONFIRMED MESSAGES STORED *

4

Fig. 4

16.58PM JUNE 8, 1998

* NO UNCONFIRMED MESSAGES *

Fig. 5

| No. | CONTROL AREA | | | | MESSAGE AREA | |
|---|---|---|---|---|---|---|
| | ORDER OF RECEIPT | LOCATION | DATE & TIME | UNCONFIRMED | ADDRESS | MESSAGE |
| 1 | 32 | 4 | 98/06/07 9:01 | 1 | 1 | CALL ME |
| 2 | 31 | 20 | 98/06/06 19:11 | 1 | 2 | NEW YORK NOW |
| 3 | 30 | 40 | 98/06/06 13:06 | 1 | 3 | EMPTY |
| 4 | 29 | 1 | 98/06/06 11:15 | 1 | 4 | MEETING, TOMORROW |
| 5 | 28 | 21 | 98/06/05 21:19 | 0 | 5 | OK ! |
| ⋮ | ⋮ | ⋮ | ⋮ | ⋮ | ⋮ | ⋮ |
| 24 | 9 | 2 | 98/06/04 8:35 | 0 | 18 | EMPTY |
| 25 | 8 | 5 | 98/06/04 8:30 | 0 | 19 | WAITING FOR YOUR CALL |
| 26 | 7 | 11 | 98/06/03 13:14 | 0 | 20 | FREE TODAY ? |
| 27 | 6 | 35 | 98/06/03 10:03 | 0 | 21 | RETURN |
| ⋮ | ⋮ | ⋮ | ⋮ | ⋮ | ⋮ | ⋮ |
| 38 | EMPTY | EMPTY | EMPTY | EMPTY | 38 | EMPTY |
| 39 | EMPTY | EMPTY | EMPTY | EMPTY | 39 | EMPTY |
| 40 | EMPTY | EMPTY | EMPTY | EMPTY | 40 | LET'S HAVE FUN |

Fig. 6a 13. 10PM JUNE 7, 1998

* UNCONFIRMED MESSAGES STORED *

4/32

Fig. 6b 13. 10PM JUNE 7, 1998

* UNCONFIRMED MESSAGES STORED *

DAY

4/32

COMMUNICATION APPARATUS CAPABLE OF DISPLAYING THE NUMBER OF UNCONFIRMED MESSAGES

BACKGROUND OF THE INVENTION

1. Field of the Invention

The present invention relates to a communication apparatus capable of displaying received messages.

2. Description of the Related Art

Generally, a radio pager or similar communication apparatus produces, on receiving a message, an alert tone while displaying the message. When the user of the apparatus presses a switch in response to the alert tone or the display of the message, the message is written to a memory as a confirmed message. On other hand, when the apparatus is put in, e.g., the user's bag and fails to urge the user to press the switch despite the alert tone or the message display, the received message is written to the memory as an unconfirmed message. The presence of the unconfirmed message is indicated on a display later. This type of radio pager is taught in Japanese laid-open patent application show a 58-501571 by way of example.

When an unconfirmed message is present, the above conventional radio pager causes a particular portion of the display to blink in order to allow the user to see the presence of the unconfirmed message. Assume that when the user causes the pager to sequentiallly read and display stored messages, the messages include an unconfirmed message. Then, on the appearance of the unconfirmed message on the display, the pager causes the particular portion of the display to blink so as to allow the user to see that the message is not confirmed yet.

Japanese laid-open patent application heisei 7-79459 discloses a radio pager constructed to count unconfirmed messages and compare the number of unconfirmed messages with a preselected reference value. When the number of unconfirmed messages exceeds the reference value, the pager informs the user of the presence of the unconfirmed messages. The user can therefore determine whether or not the number of unconfirmed messages is great.

SUMMARY OF THE INVENTION

It is therefore an object of the present invention to provide a communication apparatus constituting an improvement over the conventional radio pagers.

It is another object of the present invention to provide a communication apparatus capable of displaying the number of unconfirmed messages at least in a stand-by state thereof, there by allowing the user of the apparatus to see the number of unconfirmed messages.

It is still another object of the present invention to provide a communication apparatus allowing the user of the apparatus to see the ratio of the number of unconfirmed messages to the total number of received messages.

It is a further object of the present invention to provide a communication apparatus allowing the user of the apparatus to see the number of unconfirmed messages received within a particular period of time.

In accordance with the present invention, a communication apparatus includes a receiving section for receiving a communication signal, a storage for storing a message contained in the communication signal, a display for displaying the message, a decision section for determining whether or not the message is an unconfirmed message left unconfirmed by the user of the apparatus, and a controller for displaying on the display the number of messages determined to be unconfirmed messages by the decision section.

Also, in accordance with the present invention, a displaying method for a communication apparatus includes the steps of determining whether or not a communication signal has been received, storing a message contained in the communication signal, displaying the messages, alerting the user of the apparatus to a call incoming, determining whether or not the user has pressed a switch, storing the message as an unconfirmed message when the user does not press the switch, calculating the number of unconfirmed messages, and displaying the number of unconfirmed messages.

BRIEF DESCRIPTION OF THE DRAWINGS

These and other objects, features and advantages of the present invention will become more fully apparent from the following detailed description taken in conjunction with the accompanying drawings in which:

FIGS. 3*a*, 3*b* and 4 each shows preferable information appearing on an LCD (Liquid Crystal Display) included in the illustrative embodiment;

FIG. 5 shows a preferable format in which receives messages and their attributes are stored in a message storage also included in the illustrative embodiment;

FIGS. 6*a* and 6*b* each shows another preferable information appearing on the LCD of the illustrative embodiment;

DETAILED DESCRIPTION OF THE PREFERRED EMBODIMENTS

Figure 1:
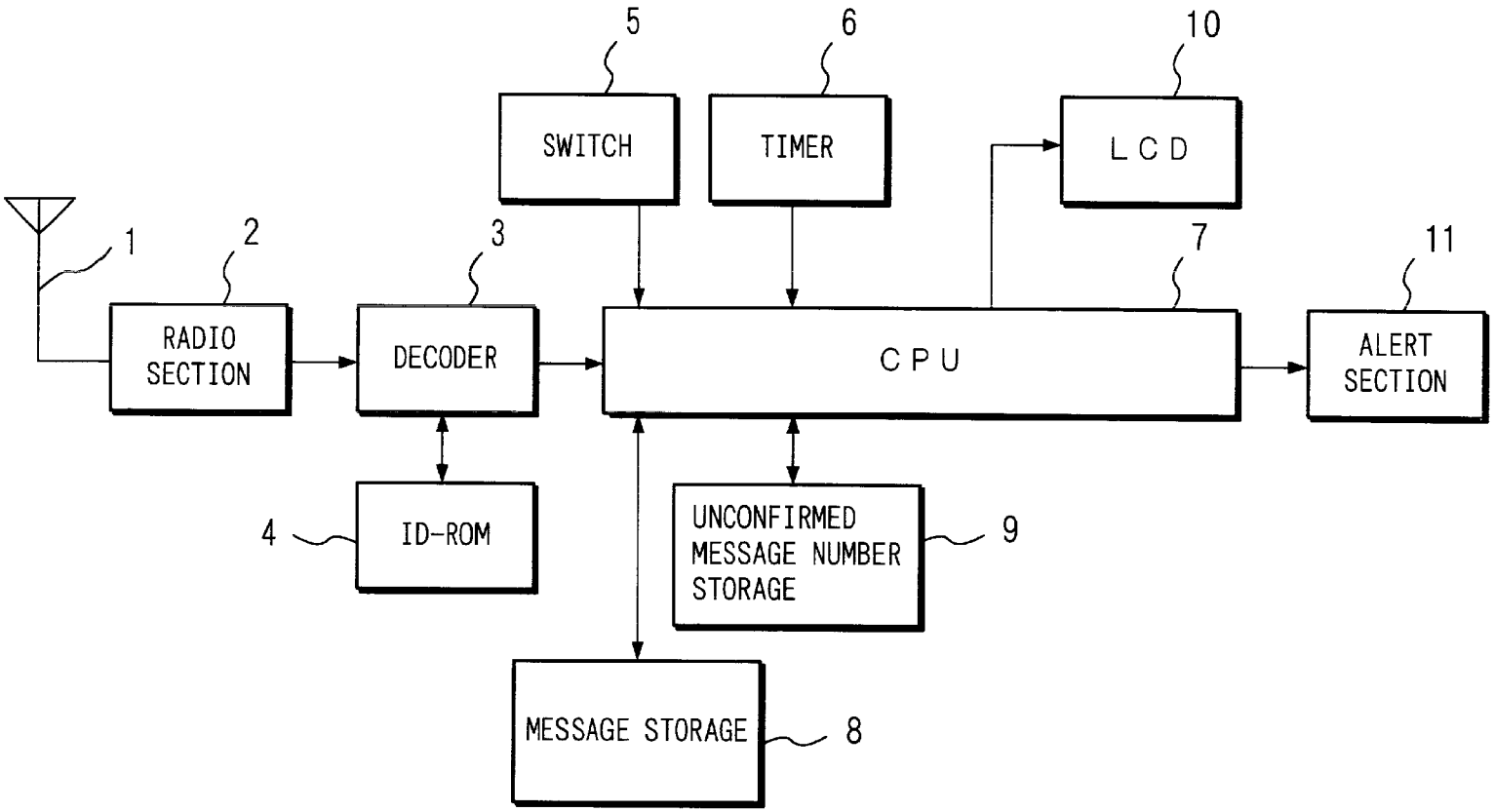
FIG. 1 is a block diagram schematically showing a communication apparatus embodying the present invention and implemented as a radio pager by way of example.

Referring to FIG. 1 of the drawings, a communication apparatus embodying the present invention is shown and applied to a radio pager by way of example. As shown, the radio pager includes an antenna 1 for receiving a radio signal based on, e.g., a POCSAG system and sent from a base station not shown. A radio section 2 amplifies and demodulates the radio signal and thereby transforms it to a wave-shaped digital signal. A decoder 3 decodes the digital signal output from the radio section 2 and compares an address number contained in the decoded signal with an address number assigned to the pager and stored in an ID-ROM (Identification Read Only Memory) beforehand. If the two address numbers are identical, the decoder 3 feeds a coincidence signal to a CPU (Central Processing Unit) 7. In response, the CPU 7 control an LCD 10 in order to display a message also contained in the digital signal and following the address number. At the same time, the CPU 7 controls an alert section 11 in order to alert the user of the pager to the call incoming. The alert section II should preferably be implemented by one of a speaker, an LED (Light Emitting Diode), and a vibrator.

The CPU 7 stores a message signal following the address number in the decoded signal in a message storage 8. This message signal is written to the storage 8 together with a receipt time based on time information output from a timer 6. Further, the CPU 7 constantly displays on the LCD 10 the number of unconfirmed messages stored in an unconfirmed message number storage 9. The words "unconfirmed messages" refer to messages which are left unconfirmed by the user at the time of alerting or message reading without a switch 5 being pressed. The switch 5 is pressed to select desired alerting means, to stop the alerting means, and to select a message reading function or similar function.

Figure 2:
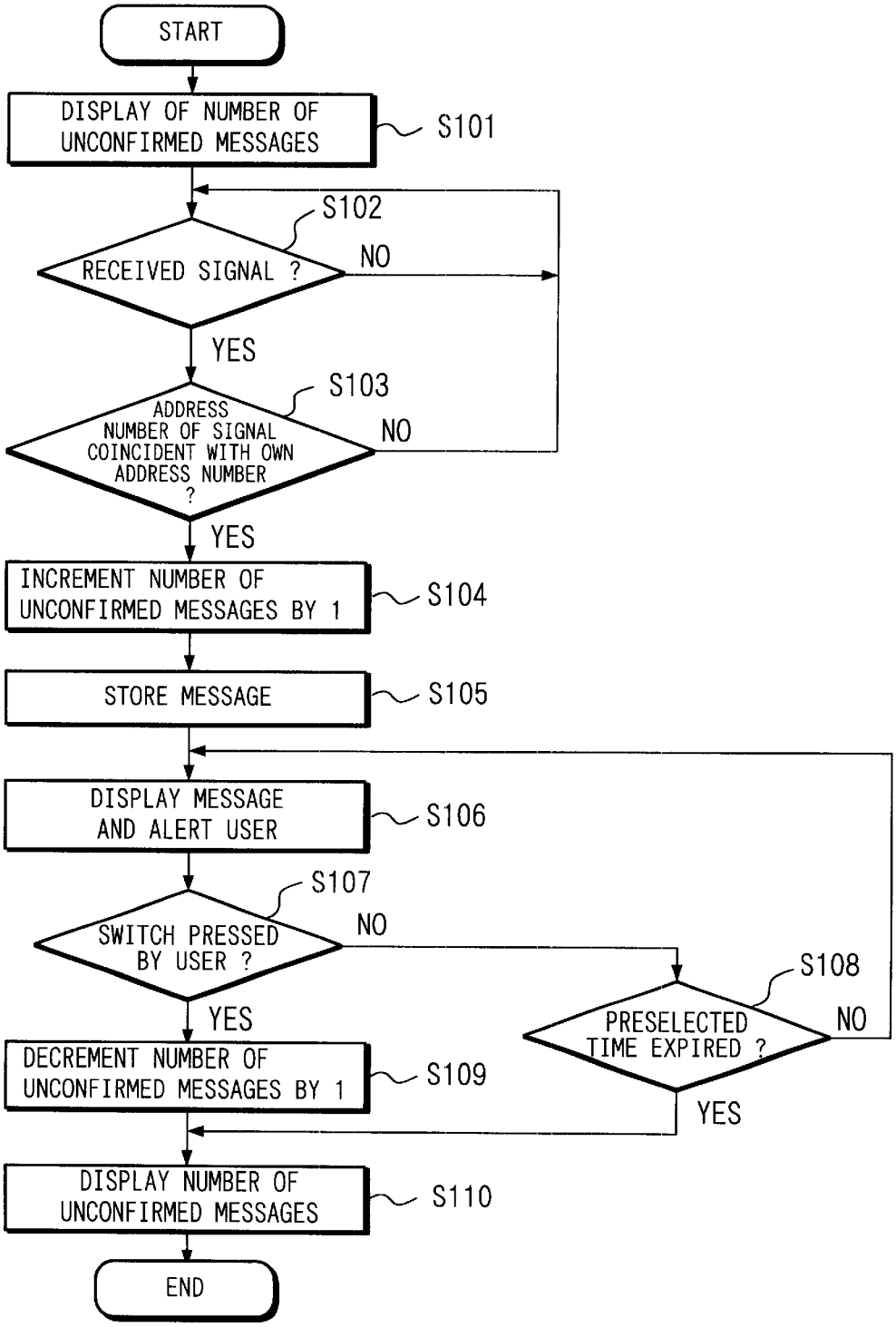
FIG. 2 is a flowchart demonstrating a preferable operation of the illustrative embodiment.

A preferable operation of the illustrative embodiment will be described with reference to FIGS. 2, 3*a* and 3*b*. As shown in FIG. 2, the CPU 7 causes the number of unconfirmed messages to constantly appear on the LCD 10 in the stand-by state of the pager (step S101). As shown in FIG. 3*a*, information showing whether or not unconfirmed messages are present may be displayed on the LCD 10 together with the number of unconfirmed messages.

When a radio signal from a base station, not shown, comes in through the antenna 1 (YES, step S102), the CPU 7 determines whether or not an address number contained in the received signal is identical with the address number stored in the ID-ROM 4 (step S103), If the two address numbers compare equal (YES, step S103), the CPU 7 increments the number of unconfirmed messages stored in the unconfirmed message number storage 9 by 1 (one), e.g., increments "3" to "4" (step S104). The CPU 7 writes the received message in the message storage 8 (step S105). Further, the CPU 7 displays the received message on the LCD 10 and drives the alert section 11 in order to alert the user to the call incoming (step S106). Then, the CPU 7 determines whether or not the user has pressed the switch 5 in response to the alert (step S107).

When the user presses the switch 5 (YES, step S107), the CPU 7 decrements the number of unconfirmed messages stored in the unconfirmed message number storage 9 by 1, e.g., from "4" to "3" (step S109). As a result, the number of unconfirmed messages "3" appears on the LCD 10 (step S110), as shown in FIG. 3*a*. FIG. 4 shows a preferable condition of the LCD 10 to occur when the number of unconfirmed messages is zero. As shown, only a message showing the absence of unconfirmed messages is shown on the LCD 10 in place of the number "0".

On the other hand, when the user does not press the switch 5 (NO, step S107), the CPU 7 determines whether or not a preselected period of time, e.g., 20 seconds have expired on the basis of the time information output from the timer 6 (step S108). If the preselected period of time expires without the switch 5 being pressed (YES, step S108), the CPU 7 causes "4" representative of the number of unconfirmed messages and stored in the storage 9 to appear on the LCD 10 (step S110), as shown in FIG. 3*b*.

As stated above, the illustrative embodiment calculates the number of unconfirmed messages on the basis of the user's operation of the switch 5, and displays the calculated number on the LCD 10 in the stand-by state of the pager. The user can therefore see the number of unconfirmed messages by looking at the LCD 10.

FIG. 5 shows a preferable format in which received messages are stored in the message storage 8 shown in FIG. 1. As shown, the storage 8 is generally made up of a control area 21 and a message area 22 and capable of storing forty messages at maximum. Received messages are sequentially written to an empty address from the lower address of the message area 22; "empty" shown in the message area 22 is representative of an idle address storing no messages. In the specific condition of FIG. 5, the next received message will be written to the address 3.

Attributes associated with a received message are written to the control area 21 when the message is written to the message area 22. The attributes of received messages are sequentially written to the control area in the order of receipt. The attributes include, e.g., the order of receipt, the location where a message is stored, the date and time of receipt, and whether or not a message has been confirmed.

In the control area 21, "Order of Receipt" indicates the position of a message with respect to the order of receipt. For example, in FIG. 5, the latest received message is provided with a number "32". This means that thirty-two messages are present in the message storage 8. The stored messages are sequentially displayed from the newest one numbered "32" to the oldest one.

In the control area 21, "Location" indicates the address of the message area 22 where the message associated with the order of receipt is stored. For example, the location of the above thirty-second received message is "4", showing that a message "Meeting, tomorrow" stored at the address No.4 is the thirty-second received message.

In the control area 21, "Date & Time" indicates the date and time of receipt of a message. The date and time are written to the control area 21 on the basis of time information output from the timer 6. A received message should preferably be displayed together with the date and time of receipt of the message, as shown in FIG. 3*a* and 3*b* specifically.

Further, in the control area 21, "Unconfirmed" is representative of information showing whether or not the corresponding received message has been confirmed by the user. This information is "1" if the message has not been confirmed or "0" if it has been confirmed. Assume that while an unconfirmed message is displayed, the user sees it and presses the switch 5. Then, the unconfirmed information associated with the unconfirmed message changes from "1" to "0".

In the illustrative embodiment, only the number of unconfirmed messages is displayed. However, as shown in FIG. 6*a*, it is preferable that the total number of received messages "32" stored in the message storage 8 be displayed together with the number of unconfirmed messages "4".

Figure 7A:
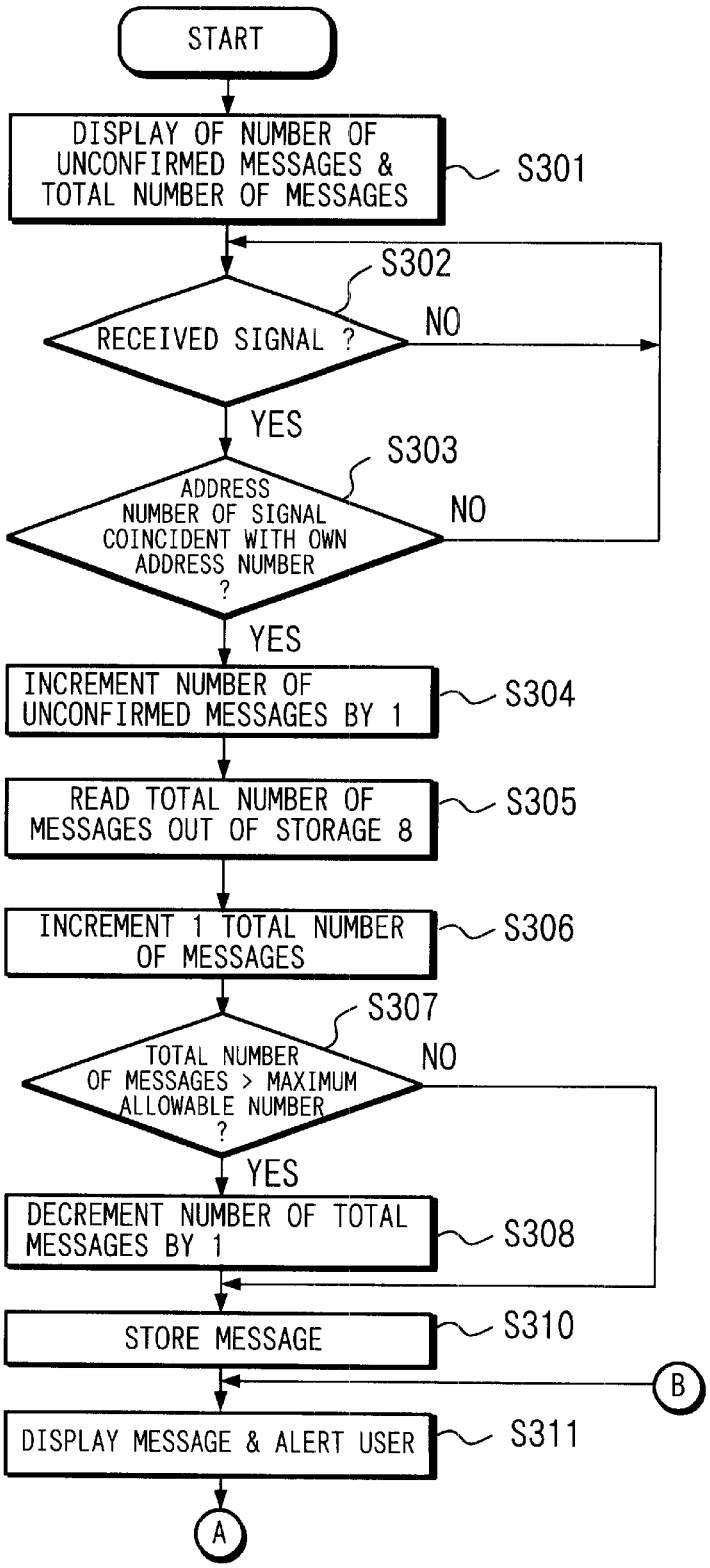
FIGS. 7*a* and 7*b* show a preferable procedure in which the illustrative embodiment displays the number of unconfirmed messages and the total number of messages.
Figure 7B:
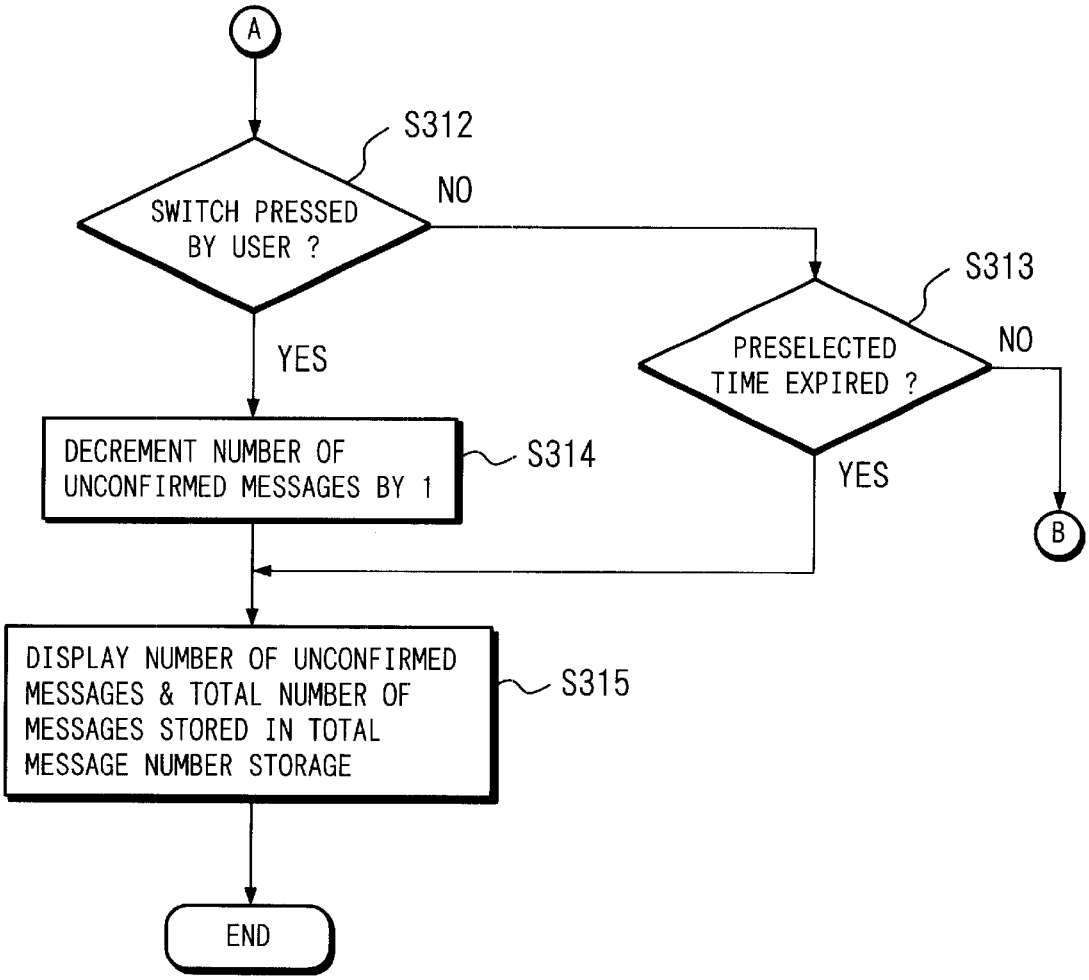

Reference will be made to FIGS. 7*a* and 7*b* for describing a preferable procedure in which the pager of FIG. 1 displays the number of unconfirmed messages and the total number of messages. As shown in FIG. 7*a*, the number of unconfirmed messages and the total number of messages are constantly displayed in the stand-by state of the pager (step S301). When a radio signal from a base station, not shown, comes in through the antenna 1 (YES, step S302), the CPU 7 determines whether or not an address number contained in the received signal is identical with the address number stored in the ID-ROM 4 (step S303), If the two address numbers compare equal (YES, step S303), the CPU 7 increments the number of unconfirmed messages stored in the unconfirmed message number storage 9 by 1 (step S304). The CPU 7 reads the total number of messages stored in the message storage 8 on the basis of the highest number of the order of receipt stored in the control area 21, FIG. 5 (step S305). The CPU 7 adds "1" to the total number of messages (step S306) and then determines whether or not the sum is greater than the maximum number of messages which can be stored in the message memory 8 (step S307). If the answer of the step S307 is positive (YES), then the CPU 7 decrements the total number of messages by 1 (step S308). As la result, the total number of messages coincides with the highest number of the order of receipt stored in the control area 21.

Steps S310 and 311 shown in FIG. 7*a* and steps S312–S314 shown in FIG. 7*b* are identical with the steps S105–S109 of FIG. 2 and will not be described specifically in order to avoid redundancy.

The number of unconfirmed messages stored in the unconfirmed message number storage 9 and the total number of messages stored a total message number storage are displayed at the same time (step S315).

As stated above, the illustrative embodiment displays not only the number of unconfirmed messages but also the total number of messages, so that the user can see both of them at the same time. In addition, the user can see the ratio of the number of unconfirmed messages to the total number of messages.

In the above embodiment, the number of unconfirmed messages is displayed in the stand-by state of the pager. Alternatively, an arrangement may be made such that when the user looking at the number of unconfirmed messages presses the switch 5, the number of unconfirmed messages occurred within a particular period of time, e.g., one day is displayed. As shown in FIG. 6*b* it is preferable that the total number of unconfirmed messages be displayed together with the particular period of time and the number of unconfirmed messages occurred within the particular period. Also, the user should preferably be allowed to select a desired period of time, e.g., a day, a week or a month.

Figure 8:
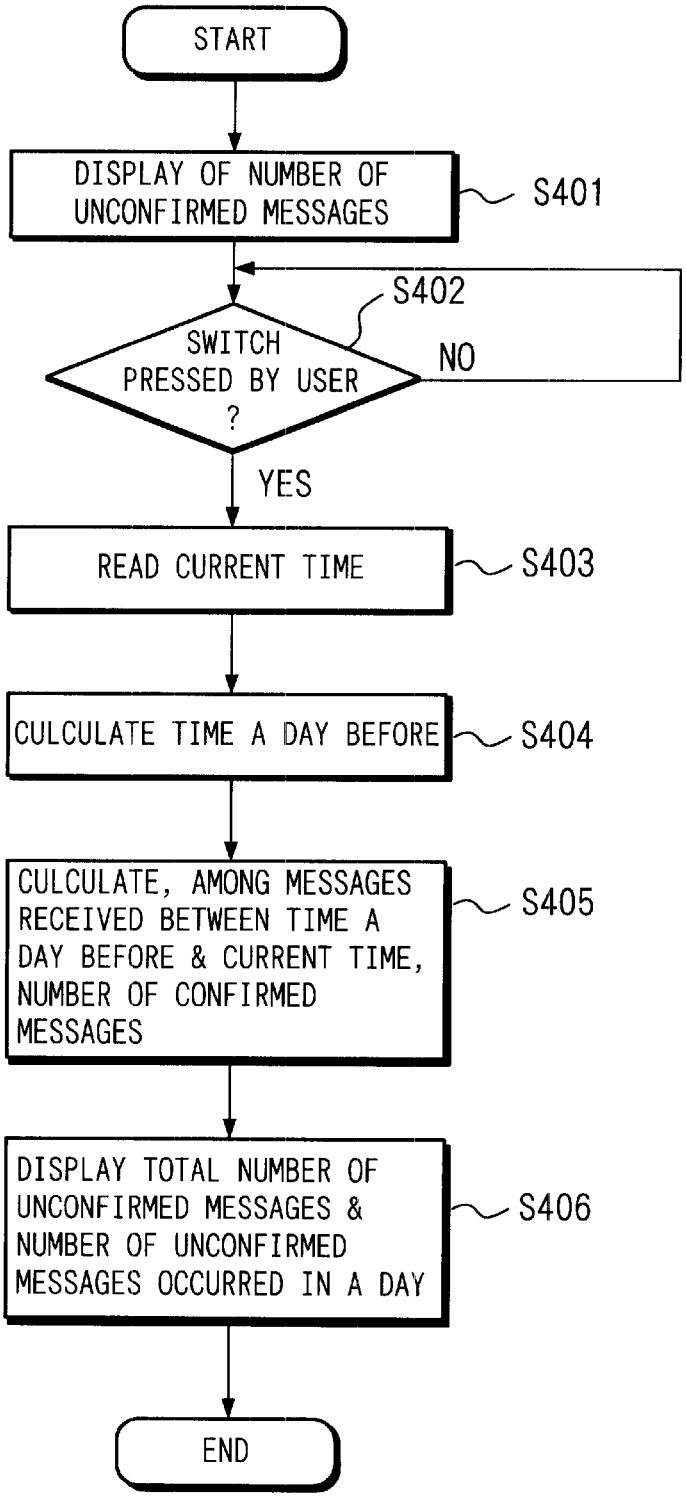
FIG. 8 shows a preferable procedure in which the illustrative embodiment displays the number of unconfirmed messages and the total number of unconfirmed messages occurred within a particular period of time.

FIG. 8 shows a preferable procedure in which the pager of FIG. 1 displays the number of unconfirmed messages and the number of unconfirmed messages occurred within the particular period of time. As shown, while the number of unconfirmed messages is displayed (step S401), the CPU 7 determines whether or not the user has pressed the switch 5 (step S402). When the user presses the switch 5 (YES, step S402), the CPU 7 reads the current time on the basis of time information output from the timer 6 (step S403). The CPU 7 calculates, based on the current time, the particular period of time selected by the user, e.g., a time a day before (step S404). Then, by referencing the dates and times of receipt stored in the control area 21, FIG. 5, the CPU 7 determines the number of unconfirmed messages included in the message as received between the time a day before and the current time. Such a number of unconfirmed messages occurred within the particular period of time appears on the LCD 10 together with the total number of unconfirmed messages.

As stated above, the above procedure displays not only the number of unconfirmed messages but also the number of unconfirmed messages occurred within a particular period of times, so that the user can see both of them at the same time. In addition, the user can see the ratio of the number of unconfirmed messages occurred within a particular period to the total number of unconfirmed messages.

Figure 9:
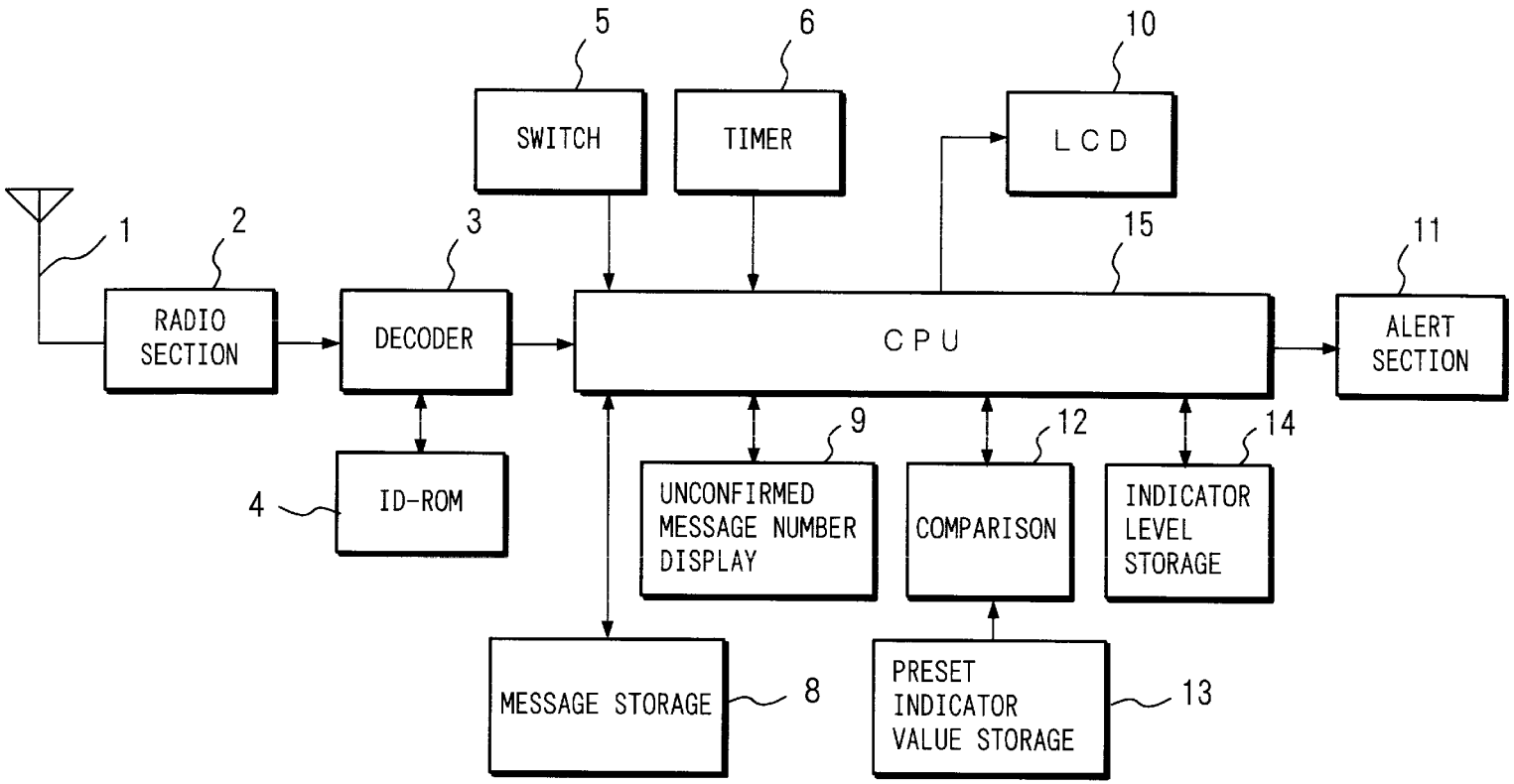
FIG. 9 is a block diagram schematically showing an alternative embodiment of the present invention and also implemented as a radio pager by way of example.

An alternative embodiment of the present invention will be described with reference to FIG. 9. This embodiment is also implemented as a pager by way of example. In FIG. 9, structural elements identical with the structural elements shown in FIG. 1 are designated by identical reference numerals and will not be described specifically in order to avoid redundancy. As shown, the alterative embodiment differs from the previous embodiment in that it additionally includes a comparison 12, a preset indicator value storage 13, and an indicator level storage 14, and has a CPU 15 in place of the CPU 7. The comparison 12 compares the number of unconfirmed messages stored in the storage 9 with preselected indicator values stored in the storage 13. The preset indicator values each is representative of the number of messages allotted to a particular indicator. For example, when ten indicators are present, four messages are allotted to each indicator because the maximum number of messages to be stored in the message storage 8 is assumed to be forty. Therefore, the indicator values stored in the storage 13 are "4, 8, 12, . . . , 32, 36, 40". The indicator level storage 14 stores an indicator level determined on the basis of the output of the comparison 14. The CPU 15 reads the indicator level out of the indicator level storage 14 and displays it on the LCD 10.

Figure 10:
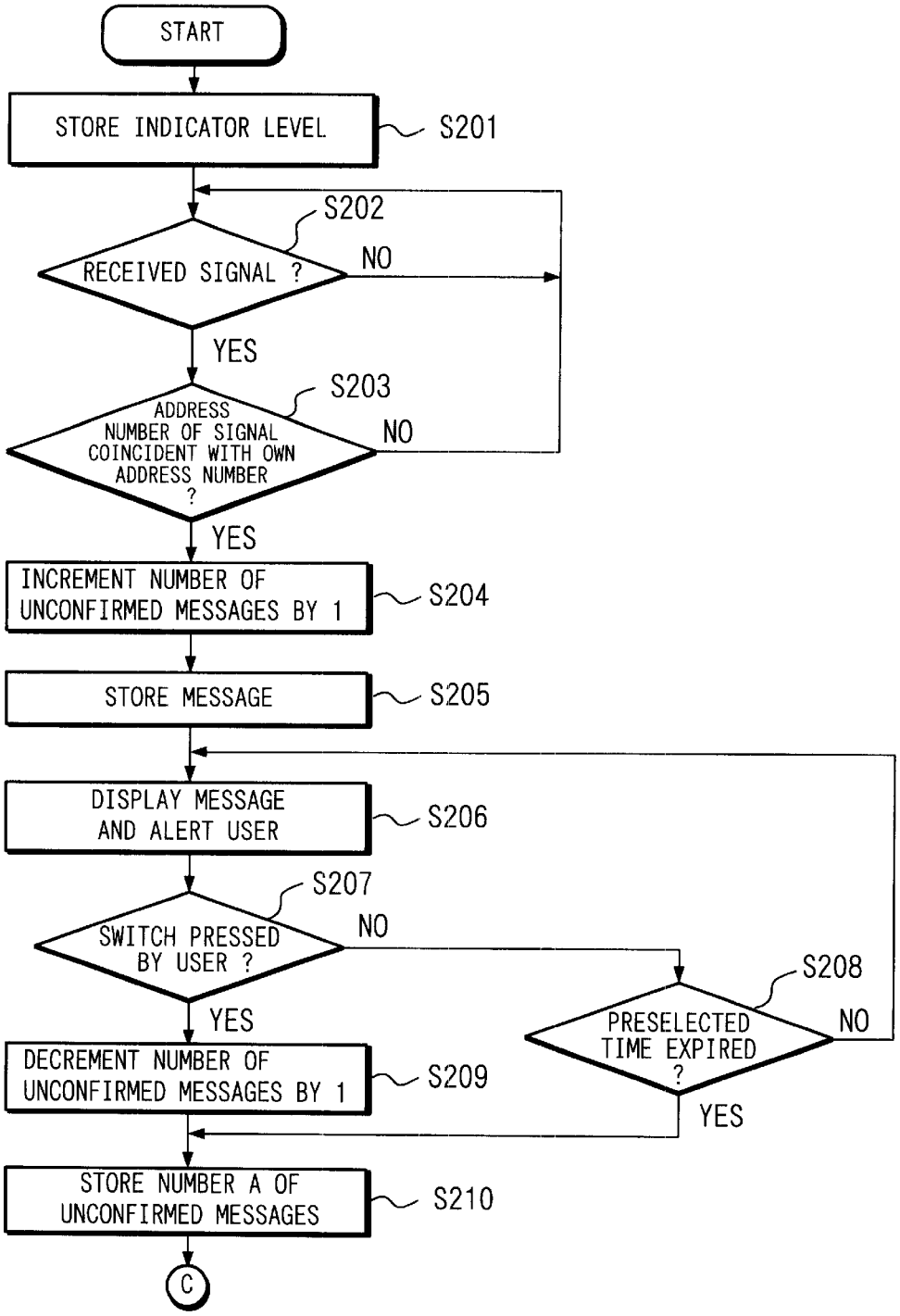
FIGS. 10 and 11 are flowcharts demonstrating a preferable operation of the alternative embodiment.
Figure 11:
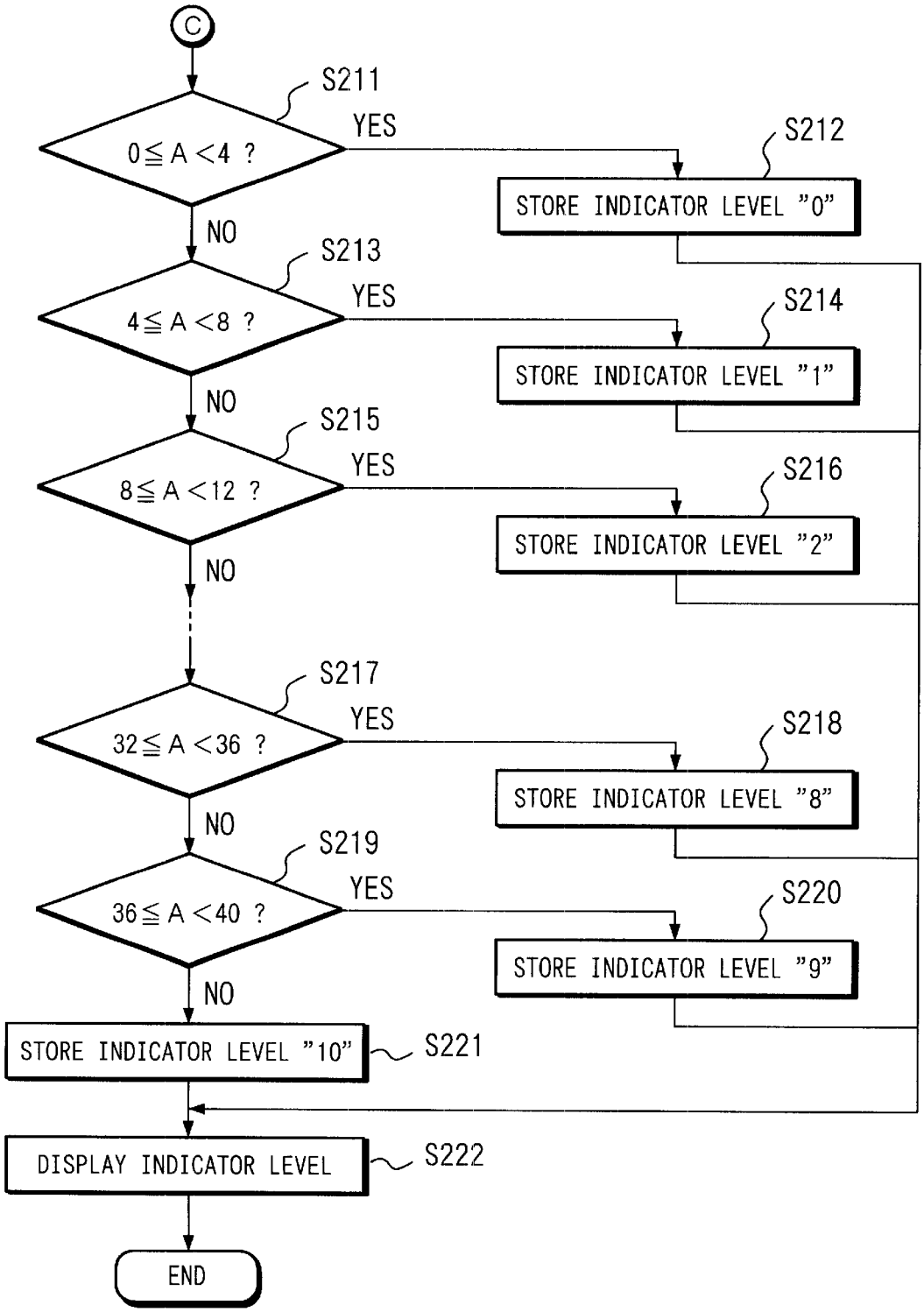
Figure 12A:
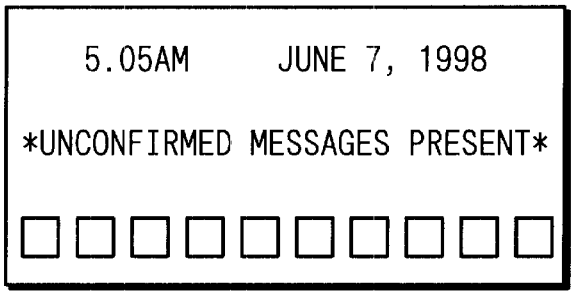
FIGS. 12*a*–12*d* and 13*a*–13*d* each shows preferable information appearing on the LCD in the alternative embodiment.

A specific operation of the alterative embodiment will be described with reference to FIGS. 10, 11 and 12*a*–12*d*. As shown in FIG. 10, an indicator level is constantly displayed (step S201). At this instant, whether or not unconfirmed messages are present should preferably be displayed together with the indicator level, as shown in FIG. 12*a*. Steps 202–209 are identical with the steps S102–109 of FIG. 2 and will not be described specifically in order to avoid redundancy.

In a step S210, the number A of unconfirmed messages is written to the unconfirmed message number storage 9. Subsequently, as shown in FIG. 11, the number A is sequentially compared with the preset indicator values stored in the storage 13. Specifically, whether or not the number A satisfies a relation of $0 \leqq A < 4$ is determined first (step S211). If the answer of the step S211 is YES, then an indicator level "0" is written to the storage 14. If the answer of the step S211 is negative (NO), then whether or not the number A satisfies a relation of $4 \leqq A < 8$ is determined (step S213). If the answer of the step S213 is YES, then an indicator level "1" is written to the storage 14 (step S214). If the answer of the step S213 is NO, then whether or not the number A satisfies a relation of $8 \leqq A < 12$ is determined (step S215). If the answer of the step S215 is YES, then an indicator level "2" is written to the storage (step S216).

If the number A does not satisfy a relation of $32 \leqq A < 36$ (NO step S217), then whether or not the number A satisfies a relation of $36 \leqq A < 40$ is determined (step S219). If the answer of the step S219 is YES, then an indicator level "9" is written to the storage 14 (step S220). If the answer of the step S219 is NO, then an indicator level "10" is written to the storage 14 on the assumption that the number A has reached the maximum number "40" (step S221).

Figure 12B:
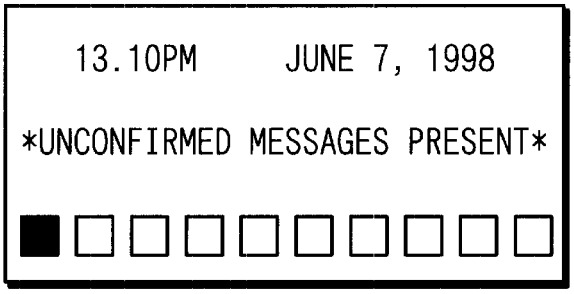
Figure 12C:
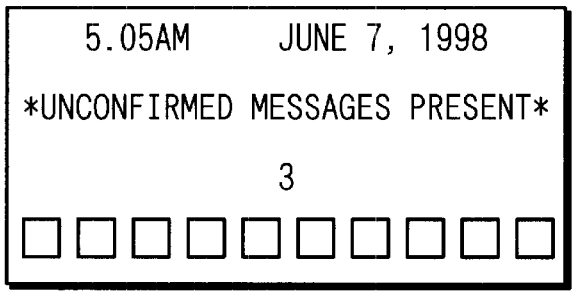
Figure 12D:
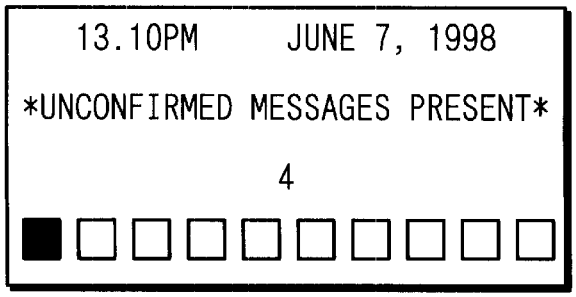

The CPU 15 displays the indicator level written to the storage 14 on the LCD 10 (step S222). For example, when the number of unconfirmed messages stored in the message storage 8 is "4", as shown in FIG. 5, the indicator level "1" appears on the LCD 10, as shown in FIG. 12*b*. While the illustrative embodiment displays only the indicator corresponding to the number of unconfirmed messages, the number of unconfirmed messages should preferably be displayed together with the indicator, as shown in FIG. 12*c* or 12*d* specifically.

The total number of received messages may also be indicated by the indicators, so that the user can recognize it.

Figure 13A:
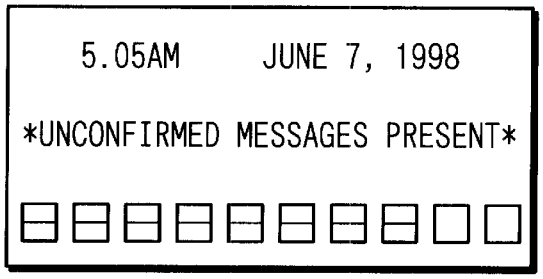
Figure 13B:
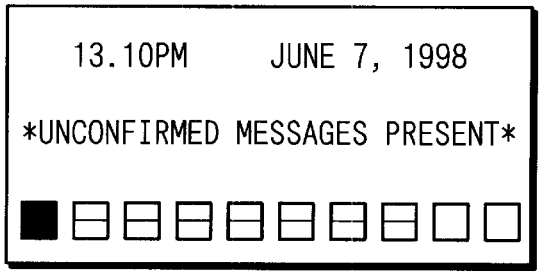
Figure 13C:
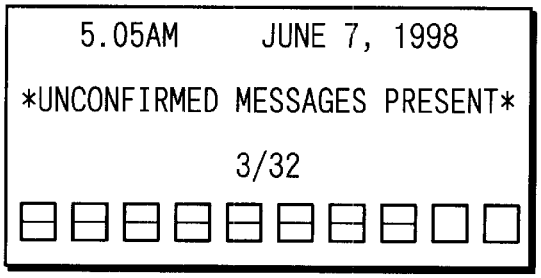
Figure 13D:
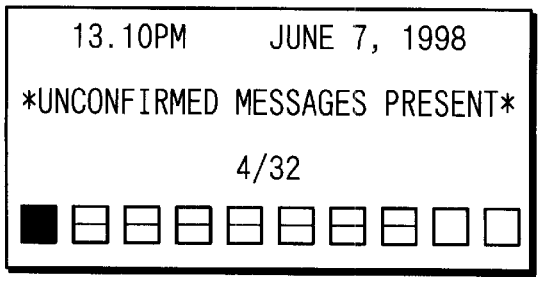

The total number of received messages "32" is derived from the attributes stored in, the control area 21 shown in FIG. 5, i.e., the position of the latest received message with respect to the order of receipt. The number "32" is sequentially compared with preset values stored in the preset indicator value storage 13, as in the steps S211–221 shown in FIG. 11. As a result, an indicator level "8" is set. As shown in FIG. 13*a* or 13*b*, the set indicator level indicative of the total number of received messages should preferably be distinguished from the indicator level indicative of the number of unconfirmed messages by, e.g., a sign "–". Preferably, as shown in FIG. 13*c* or 13*d*, not only the indicators respectively representative of the number of unconfirmed messages and the total number of received messages but also the number of unconfirmed messages and the total number of received messages should be displayed.

Further, it is preferable that the user be capable of determining whether or not the number of unconfirmed messages should be constantly displayed. If constant display of the number of unconfirmed message is not desired, then the number should preferably be displayed when the user presses the switch 5.

In summary, it will be seen that the present invention provides a communication apparatus capable of constantly displaying the number of unconfirmed messages and allowing it to be recognized by the user of the apparatus immediately. Moreover, because the apparatus of the present invention displays the total number of messages together with the number of unconfirmed messages, the user can see the ratio of the number of unconfirmed messages to the total number of received messages.

Obviously, numerous additional modifications and variations of the present invention are possible in light of the above teachings. It is therefor to be understood that within the scope of the appended claims, the invention may be practiced otherwise than as specifically described herein.

What is claimed is:

1. A communication apparatus comprising:

receiving means for receiving a communication signal;

storing means for storing a message contained in the communication signal;

display means for displaying the message;

decision means for determining whether or not the message is an unconfirmed message left unconfirmed by a user of said apparatus; and control means for displaying on said display means a number of messages determined to be unconfirmed messages by said decision means, wherein said display means displays a total number of received messages stored in said storing means together with said number of messages determined to be unconfirmed messages, and wherein said display means displays a period of time during which the unconfirmed messages were received.

2. The apparatus as claimed in claim 1, further comprising alerting means for alerting the user to a call incoming.

3. The apparatus as claimed in claim 1, wherein said decision means determines whether or not the user operated a switch when said alerting means is alerting the user to the call incoming.

4. The apparatus as claimed in claim 1, wherein said control means displays the number of unconfirmed messages in a stand-by state of said apparatus.

5. The apparatus as claimed in claim 1, wherein said control means displays the number of unconfirmed messages when the user operates a switch in a stand-by state of said apparatus.

6. The apparatus as claimed in claim 1, wherein said control means displays information showing whether or not unconfirmed messages are stored in said storing means and information showing the number of unconfirmed messages.

7. The apparatus as claimed in claim 6, further comprising detecting means for detecting a total number of messages stored in said storing means.

8. The apparatus as claimed in claim 7, wherein said detecting means comprises:

reading means for reading a total number of messages stored in said storing means;

adding means for adding 1 (one) to the total number of messages read by said reading means;

comparing means for comparing a total number of messages output from said adding means and a maximum number of messages for being stored in said storing means;

deleting means for deleting an oldest message present in said storing means when said comparing means determines that the total number of messages output from said adding means is greater than the maximum number of messages;

subtracting means for subtracting I from the total number of messages output from said adding means; and second display means for displaying the total number of messages.

9. The apparatus as claimed in claim 8, wherein said control means displays the information showing whether or not unconfirmed messages are present, the number of unconfirmed messages, and the total number of messages detected by said detecting means.

10. The apparatus as claimed in claim 7, further comprising extracting means for extracting, among the messages stored in said storing means, the unconfirmed messages occurred within a particular period of time, and calculating means for calculating a number of unconfirmed messages extracted by said extracting means.

11. The apparatus as claimed in claim 10, wherein said control means displays the information showing whether or not unconfirmed messages are present, the number of unconfirmed messages and the number of unconfirmed messages output from said calculating means.

12. The apparatus as claimed in claim 10, wherein a user input sets the particular period of time on a switch.

13. The apparatus as claimed in claim 6, further comprising:

comparing means for comparing the number of unconfirmed messages and a plurality of preselected values; and setting means for setting, based on a result of comparison output from said comparing means, an indicator level representative of the number of unconfirmed messages.

14. The apparatus as claimed in claim 13, wherein said control means displays the indicator level set by said setting means.

15. The apparatus as claimed in claim 1, wherein said apparatus comprises a radio pager, the communication signal comprising a radio signal.

16. The apparatus as claimed in claim 15, further comprising second decision means for determining whether or not an address number contained in the radio signal is identical with an address number stored in said apparatus.

17. A communication apparatus comprising:

a receiving section for receiving a communication signal;

a message storage for storing a message contained in the communication signal;

a display for displaying the message;

a decision section for determining whether or not the message is an unconfirmed message left unconfirmed by a user of said apparatus; and a controller for displaying on said display a number of messages determined to be unconfirmed messages by said decision section, wherein said controller displays a total number of received messages stored in said message storage together with said number of messages determined to be unconfirmed messages, and wherein said display displays a period of time during which the unconfirmed messages were received.

18. The displaying method for a communication apparatus, comprising:

determining whether or not a communication signal has been received;

storing a message contained in the communication signal;

displaying the messages;

alerting a user of said apparatus to a call incoming;

determining whether or not the user has pressed a switch;

storing the message as an unconfirmed message when the user does not press said switch;

calculating a number of unconfirmed messages;

displaying the number of unconfirmed messages.

displaying a total number of received messages stored together with the number of messages determined to be unconfirmed messages; and displaying a period of time during which the number of unconfirmed messages were received.

19. The method as claimed in claim 18, further comprising:

reading a total number of messages received;

adding 1 to the total number of messages; and displaying a resulting total number of messages and the number of unconfirmed messages.

20. The method as claimed in claim 18, further comprising:

reading a current time;

calculating a time a preselected period of time before the current time;

calculating the number of, among messages received between the time the preselected time before the current time and the current time, a number of unconfirmed messages; and displaying the number of unconfirmed messages calculated and the total number of unconfirmed messages.

21. The method as claimed in claim 18, further comprising comparing the number of unconfirmed messages with a plurality of preselected values, setting an indicator level on the basis of a result of comparison, and displaying the indicator level.

22. The apparatus as claimed in claim 1, wherein a user input sets said display of said number of unconfirmed messages by said control means to be constantly displayed.

23. The apparatus as claimed in claim 17, wherein a user input sets said display of said number of unconfirmed messages by said controller to be constantly displayed.

24. The apparatus as claimed in claim 18, wherein a user input sets said displaying of said number of unconfirmed messages to be constantly displayed.

* * * * *